US008790046B2

(12) United States Patent
Ross

(10) Patent No.: US 8,790,046 B2
(45) Date of Patent: Jul. 29, 2014

(54) HIGH PRESSURE SLURRY NOZZLE

(75) Inventor: Richard Ross, Louisville, CO (US)

(73) Assignee: Rampart Technologies, Inc., Lafayette, CO (US)

( * ) Notice: Subject to any disclaimer, the term of this patent is extended or adjusted under 35 U.S.C. 154(b) by 101 days.

(21) Appl. No.: 13/484,038

(22) Filed: May 30, 2012

(65) Prior Publication Data

US 2012/0308311 A1 Dec. 6, 2012

Related U.S. Application Data

(60) Provisional application No. 61/491,780, filed on May 31, 2011.

(51) Int. Cl.
*B05B 1/00* (2006.01)
*E02D 17/18* (2006.01)

(52) U.S. Cl.
USPC ..... 405/302.4; 405/302.6; 239/525; 239/587.5

(58) Field of Classification Search
CPC .... E02D 17/18; B05B 13/005; B05B 15/066; B05B 15/065
USPC ..... 239/525, 587.2, 587.5, 587.6, 600; 405/269, 302.4, 302.6
See application file for complete search history.

(56) References Cited

U.S. PATENT DOCUMENTS

| | | | | |
|---|---|---|---|---|
| 3,524,320 | A | 8/1970 | Turzillo | |
| 3,895,929 | A | 7/1975 | Jysky | |
| 4,044,525 | A | 8/1977 | Forsgren | |
| 4,592,675 | A | 6/1986 | Scales | |
| 5,215,127 | A * | 6/1993 | Bergeron | 141/10 |
| 5,669,732 | A | 9/1997 | Truitt | |
| 5,771,665 | A * | 6/1998 | Nelson et al. | 53/459 |
| 6,085,810 | A | 7/2000 | Castillo | |
| 6,553,713 | B2 | 4/2003 | Chiu | |
| 7,452,165 | B2 * | 11/2008 | Tyler | 405/302.6 |
| 7,798,431 | B2 * | 9/2010 | Eader | 239/572 |
| 2004/0047688 | A1 * | 3/2004 | Clement | 405/115 |
| 2011/0011037 | A1 | 1/2011 | Kean | |

* cited by examiner

*Primary Examiner* — Benjamin Fiorello
(74) *Attorney, Agent, or Firm* — Swanson & Bratschun, L.L.C.

(57) ABSTRACT

An embankment system comprises a source of pressurized sand/concrete slurry and a delivery conduit in fluid communication with the pressurized sand/concrete slurry source. The embankment system further comprises an elongate nozzle having an inlet and an outlet, with the inlet operatively associated with a distal end of the delivery conduit. A tube formed of a sheet material having an open end and a closed end is operatively associated with the nozzle outlet to receive the pressurized sand/concrete slurry through the open end, such that the tube is continuously filled with the pressurized sand/concrete slurry between the closed end and the open end.

4 Claims, 7 Drawing Sheets

HIGH PRESSURE SLURRY NOZZLE

RELATED APPLICATIONS

This application claims priority from U.S. Provisional Patent Application Ser. No. 61/491,780, filed May 31, 2011, entitled "Embankment System," which is hereby incorporated by reference.

TECHNICAL FIELD

Embankments such as embankments for flood control and liquid containment and more particularly an embankment system using high pressure sand/concrete slurry injected into a tube.

BACKGROUND

Sand bags have long been used as an emergency embankment for holding back flood waters or containing liquids. However, sand bags require the use of many individual workers and are cumbersome and slow to assemble into an embankment. Other embankment systems such as water filled barriers (known commercially as AQUA TUBES), geo cells, retainment wall systems and jumbo sand bags have been used as alternatives, with each having recognized drawbacks.

More recently, tubular sand bag systems have been introduced that use long tubes filled with sand to build embankments. These systems typically rely on gravity feeding of the sand into the tube and are subject to blockage in the sand feed apparatus. Known systems have also not been able to construct embankments over about five feet in height. Finally, the sand tube embankments are not very durable and are subject to failure if the containment tube is damaged.

The present disclosure is directed toward overcoming one or more of the problems discussed above.

SUMMARY OF THE EMBODIMENTS

Figure 1:
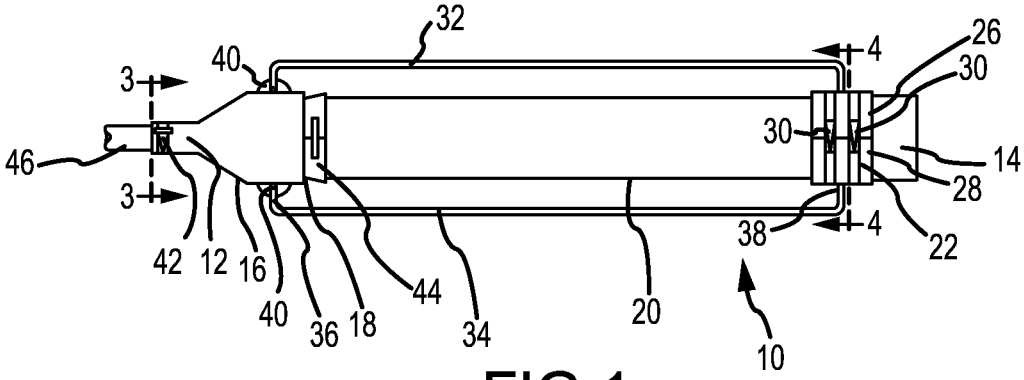
FIG. 1 is a plan view of a nozzle for use with a source with high pressure sand/concrete slurry.

An embankment system comprises a source of pressurized sand/concrete slurry and a delivery conduit in fluid communication with the pressurized sand/concrete slurry source. The embankment system may further comprise an elongate nozzle having an inlet and an outlet, with the inlet operatively associated with a distal end of the delivery conduit. A tube may be formed of sheet material and have an open end and a closed end. The tube may be operatively associated with the nozzle outlet to receive the pressurized sand/concrete slurry through the open end, and the tube may be continuously filled with the pressurized sand/concrete slurry between the closed end and the open end.

In some embodiments, the embankment system may further comprise the tube being received on an exterior of the nozzle. The nozzle may comprise a collar configured to nest the nozzle near the outlet end, whereby the collar may further comprise first and second collar segments that are releasably joined by at least one releasable clamp. The nozzle may further comprise first and second handles, whereby each handle has a proximal and distal end, with the proximal end of the handle at the collar segment being pivotly attached to the nozzle at a distance lengthwise of the nozzle outlet. The releasable clamps may disengage the first and second collar segments, thereby allowing the collar segments to be pivoted apart by the handles.

In some aspects, the tube may be scrunched lengthwise on an exterior surface of the nozzle, with the open end of the tube attached to the nozzle near the pivotable attachment of the proximal handle ends, and the closed end of the tube located downstream of the nozzle outlet. The elongate tube might further be folded about its axis into pleats, for instance, in a manner providing pleat by pleat lengthwise release of the tube as it is filled with sand/concrete slurry. In another aspect, the source of the high pressure sand/concrete slurry may be a high pressure pump. The delivery conduit may further be incorporated into an articulating boom. In some embodiments, the source of pressurized sand/concrete slurry, the delivery conduit, the elongate nozzle, and the tube are provided on a vessel suitable for delivering the filled tube to the shore of a waterway.

Another embodiment may comprise a nozzle for use with a source of high pressure sand/concrete slurry mix, whereby the nozzle comprises an inlet that is attachable in fluid communication with the source, and an outlet that is spaced lengthwise from the inlet. The nozzle may further comprise a collar configured to nest the nozzle near the outlet end, whereby the collar may have first and second collar segments that are releasably joined by one or more releasable clamps forming the collar. The first and second handles, each having a proximal and a distal end, may be pivotly attached at the proximal end to the nozzle at a distance lengthwise of the nozzle outlet. The first and second handles may further be attached at the distal end to a collar segment so that the releasable clamps that are disengaged by the first and second collar segments can be pivoted apart by the handles.

In a further aspect, the nozzle may comprise an elastomeric gasket on the inside of the collar to contact the nozzle when the collar is clamped. The handles may be metal bars configured to enable manipulation of the nozzle by one or more users. In another aspect, the source of the high pressure sand/concrete slurry may be a high pressure articulating boom pump.

Another embodiment may comprise a method for deploying a pyramid wall embankment along a length of an area. The method might comprise creating a base layer of the pyramid by laying slurry-filled tubes lengthwise in a plurality of parallel rows along the length of the area, with each parallel row placed a distance away from adjacent parallel rows so that a gap is defined between each row. Additional rows of slurry-filled tubes may be nested lengthwise and in parallel at the gaps defined by the base layer to form a second layer. The method may further comprise repeatedly nesting additional layers of slurry-filled tubes in lengthwise parallel formation at the gaps until a desired wall height or pyramid top is achieved, whereby each slurry-filled tube may be nested into formation while it is injected with the a slurry.

The method may further comprise laying each slurry-filled tube end-to-end with a contiguous slurry-filled tube in the same row, so that leakage between the ends of contiguous slurry-filled tubes is minimized. The contiguous ends of the slurry-filled tubes may further be staggered relative to the adjacent rows of slurry-filled tubes to further minimize leakage. In another aspect, a water-proof membrane may be interwoven within the structure of the pyramid wall, and may be further covered by a layer of slurry-filled tubes. In some embodiments, the water-proof membrane may be received below the surface of the ground where the wall embankment is located. In some embodiments, the tube may comprise a water-proof sheet material, and the tube may be deployed in liquids.

DETAILED DESCRIPTION

Unless otherwise indicated, all numbers expressing quantities of ingredients, dimensions reaction conditions and so forth used in the specification and claims are to be understood as being modified in all instances by the term "about".

In this application and the claims, the use of the singular includes the plural unless specifically stated otherwise. In addition, use of "or" means "and/or" unless stated otherwise. Moreover, the use of the term "including", as well as other forms, such as "includes" and "included", is not limiting. Also, terms such as "element" or "component" encompass both elements and components comprising one unit and elements and components that comprise more than one unit unless specifically stated otherwise.

FIG. 1 is a plan view of a high-pressure nozzle 10 for use with a source of high-pressure sand/concrete slurry. The nozzle 10 is elongate and has an inlet 12 and an outlet 14. Downstream of the inlet 12, the outer diameter of the nozzle flares at 16 and steps to a slightly smaller diameter at 18 to a main body 20. By way of example, the nozzle inlet 12 may have an outer diameter of about 6 inches and flares at 16 over a distance of about 8 inches to an outer diameter of about 14 inches and then reduces at the step 18 to an outer diameter of about 12 inches. Further by way of example, the main body of the nozzle 20 comprises the majority of the length of the nozzle and may be, for example, 96 inches of a total 122 inch length.

Figure 4:
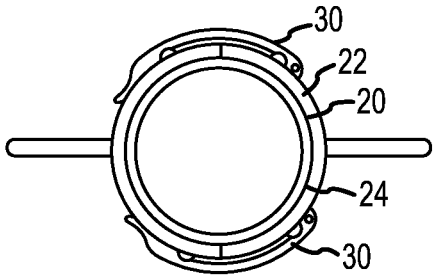
FIG. 4 is a cross-sectional view taken along line 4-4 of FIG. 1.

A retention collar 22 is provided proximate the outlet 14 and is configured to nest the main body of the outlet 14. Referring to FIG. 4, the retention collar 22 may be lined with elastomeric gaskets 24 which are sized to contact the outer diameter of the main body 20 with the retention collar closed. The retention collar 22 comprises first and second collar segments 26, 28 which are releasably joined by one or more releasable retention collar clamps 30, which may feature quick lock and release fasteners. In the embodiment described herein, a total of four retention collar clamps 30 are provided with two axially spaced retention clamps joining each side of the first and second collar segments 26, 28. Design criteria such as the outer diameter of nozzle, the pressure of the sand/concrete slurry injected into the tube and the outer diameter of the tube may affect the size and number of retention clamps used in practice. First and second handles 32, 34, each having a proximal end 36 and a distal end 38, are pivotally attached at their proximal end 36 to the nozzle a distance spaced lengthwise of the nozzle outlet 14. In the embodiment illustrated herein, the proximal ends 36 are pivotally attached at the hinges 40 proximate the nozzle inlet 12, and more particularly immediately downstream of the flare 16. The distal ends 38 of each handle are fixedly attached to the first and second collar segment 26, 28.

The nozzle 10 further includes an inlet clamp 42 for use in attaching the nozzle 10 to a delivery conduit in fluid communication with a pressurized sand/concrete slurry source. More than one inlet clamp may be required for different embodiments. The nozzle 10 further includes a tube attachment clamp 44 at a proximal end of the main body 20.

Figure 2:
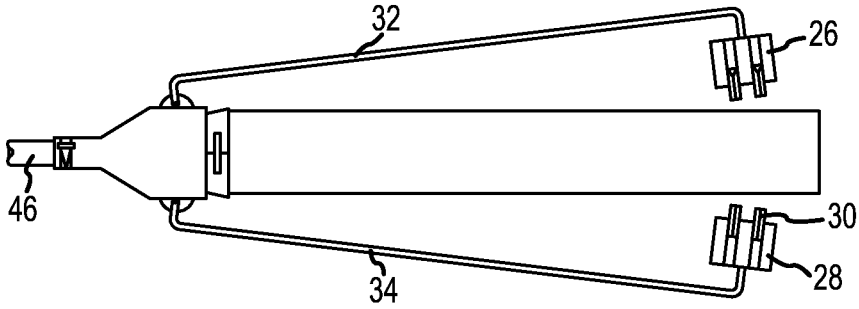
FIG. 2 is a plan view of the nozzle of FIG. 1 with the handles and collar pivoted open.

FIG. 2 is similar to FIG. 1, only showing the retention collar clamps 30 disengaged and the first and second collar segments 26, 28 and the respective first and second handles 32, 34 pivoted apart to release the nozzle main body 20.

Figure 3:
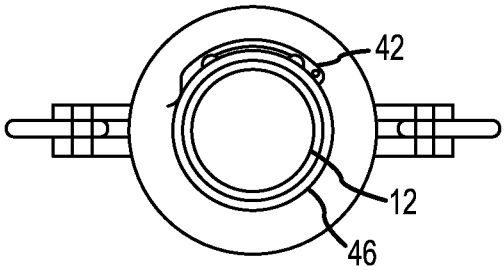
FIG. 3 is a cross-sectional view taken along line 3-3 of FIG. 1.

FIG. 3 is a cross-section taken along lines 3-3 of FIG. 1 and illustrates the inlet clamp 42 clamped about the inlet 12 and receiving a delivery conduit 46 within the inlet clamp 42. FIG. 4 is a cross-section taken along lines 4-4 of FIG. 1 and illustrates the retention collar clamps 30 clamping the retention collar 22 to nest the main body 20 of the high-pressure nozzle 10 therein.

Figure 5:
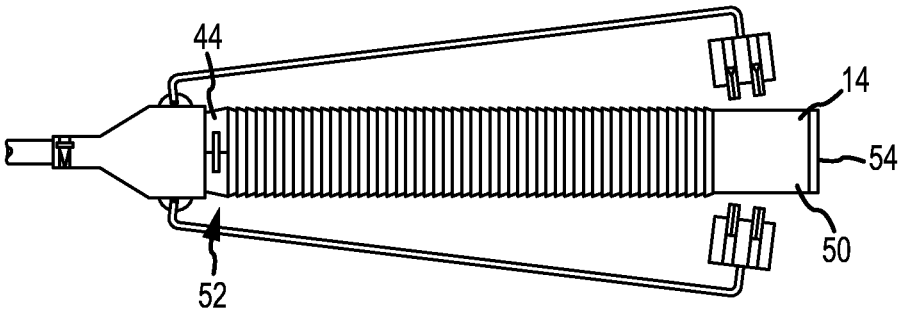
FIG. 5 is a plan view of the nozzle of FIG. 1 with an elongate tube folded about its axis into pleats on the nozzle with the handles and collar pivoted open.

FIG. 5 is similar to FIG. 2, but includes a tube 50 made of a sheet material received on the main nozzle body 20. The tube 50 may be made of any one of a variety of geotextiles, nylon reinforced plastic, or any other sheet material suitable for containing a sand/concrete slurry. The tube 50 includes an open or proximal end 52 and a closed or distal end 54. The tube 50 is scrunched lengthwise on the exterior surface of the nozzle 10, more particularly in the embodiment shown in FIG. 5, on the outer diameter of the main body 20 with the open or proximal end 52 attached to the nozzle 10 near the pivotal attachment of the proximal handle ends by means of the tube attachment clamp 44 and the closed or distal end 54 just downstream of the nozzle 10 outlet 14. In the embodiment illustrated in FIG. 5, the elongate tube is folded about its axis into pleats in a manner providing pleat by pleat lengthwise release of the tube as the tube is filled with sand/concrete slurry as will be discussed in greater detail below. More particularly, the pleats are pre-formed so that the peak folds point away from the outlet 14 end of the nozzle 10 when deployed on the nozzle 10.

Figure 6:
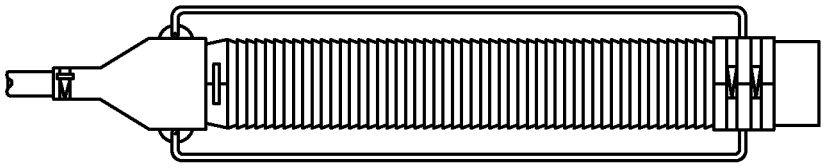
FIG. 6 is a plan view nozzle of FIG. 5 with the handles and collar pivoted closed.

In one embodiment, the pleated tube is formed as a cartridge which can be readily slid onto the tube when deployed. In some embodiments it may be desirable to have a cylindrical liner upon which the tube is formed and which underlies the pleated tube in use, thereby easing storage, shipment, loading, and attachment to the nozzle 10. The cylindrical liner may be constructed of light weight material, such as high strength cardboard and treated to repel water to increase its lifespan and reusability. In other embodiments the cylinder may be removed prior to loading the pleated tube onto the nozzle 10. FIG. 6 illustrates the first and second collar segments 26, 28 joined by the retention collar clamps 30 about a non-pleated portion of the tube proximate the closed or distal end 54.

Figure 7:
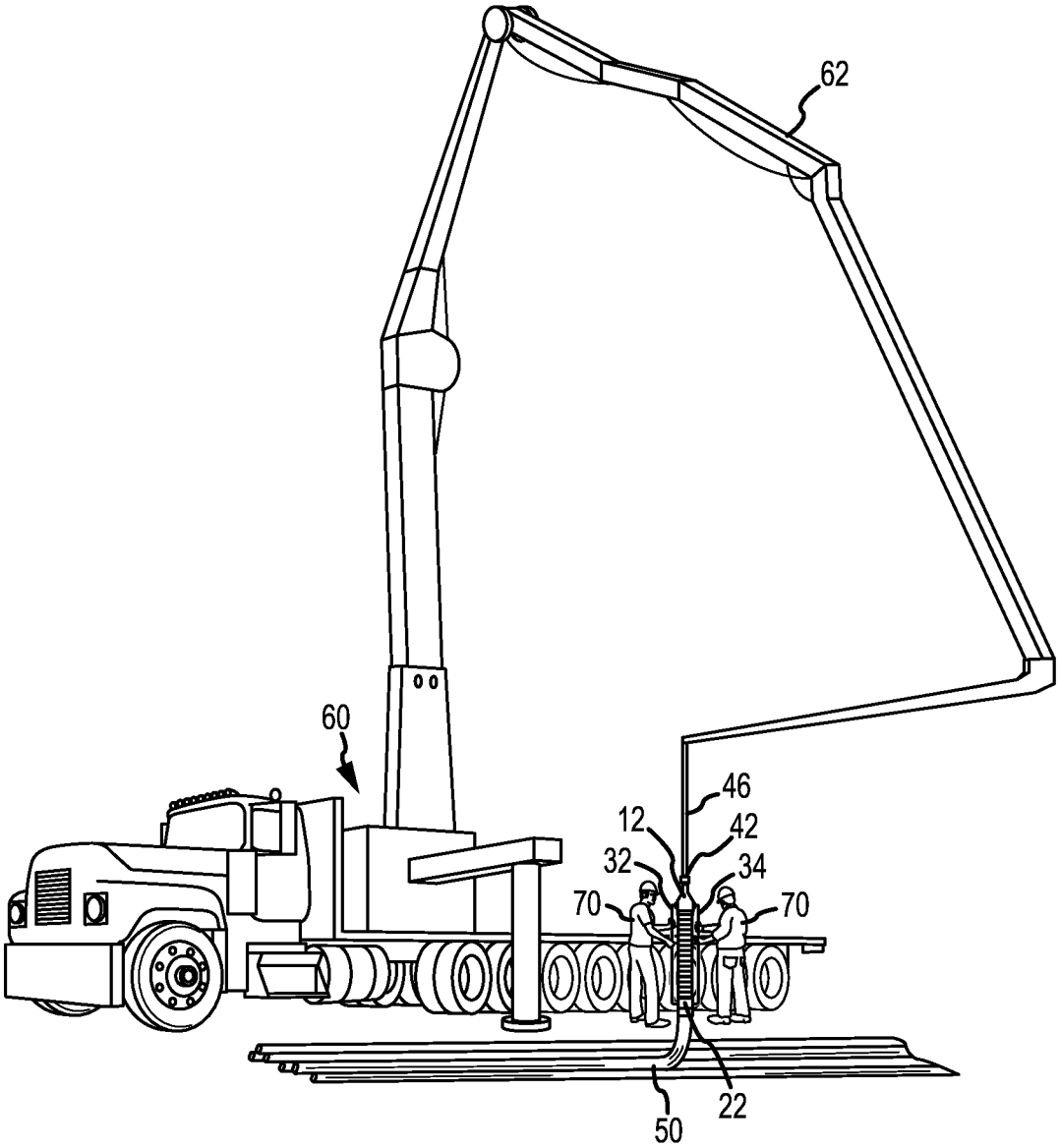
FIG. 7 is a schematic representation of workers laying an embankment using the nozzle depicted in FIGS. 1-6 in association with a high-pressure articulating boom.

FIG. 7 is a schematic representation of workers laying an embankment using the nozzle 10 in association with a high-pressure articulating boom pump system 60, which can act as the source of pressured sand/concrete slurry for filling the tubes with the sand/concrete slurry. As illustrated in FIG. 7, the high-pressure articulating boom pump 60 is a mobile concrete boom pump with substantial horizontal reach and stable radius. For example, a minimum horizontal reach of 220 feet or more is desirable along with a stable radius of 240° or more. Desirable is the use of the pump truck having a minimum per hour capacity of 270 cubic yards of sand/concrete slurry. A standard rear-load hopper that can accommodate two transit mixers with staggered loads to minimize downtime is suitable for use with the system. The sand/concrete slurry is pumped to the nozzle 10 at a high pressure which prevents clogging and allows for rapid deployment of the tubular bag 50 as it fills with the slurry. The nozzle 10 is configured for attachment to a distal end of a delivery conduit 46 by the inlet clamp 42 which is strong enough to support the nozzle 10 and portions of the filled tube 50 from the delivery conduit 46. The material used for the nozzle 10 may be a durable milled metal to withstand friction and wear on the nozzle 10.

The clamping force on the retention collar 22 and its associated elastomeric (e.g., rubber) gaskets 24 is sufficient to provide controlled release of the tube 50 from the main body 20 of the nozzle 10 as the tube 50 is filled with sand/concrete slurry. More particularly, as the high-pressure sand/concrete slurry is delivered to the nozzle, the force of the sand/concrete slurry pulls the tube 50 from under the retention collar 22, and pressure from the gaskets 24 prevents bunching of the bagging materials during deployment. In one embodiment, the pleats of the retention collar 22 are formed so that the tube 50 is fed through the retention collar 22 in a controlled manner to minimize pinching and uncontrolled release of the tube 50 as it is filled with the sand/concrete slurry. The first and second handles 32, 34 can be grasped by two or more workers 70 to precisely control placement of the tube as it is filled with the sand/concrete slurry.

Once a tube 50 is laid as desired, the flow of the sand/concrete slurry can be halted and the tube 50 can be released from the nozzle 10 by disengaging the retention collar clamps 30, pivoting the first and second handles 32, 34 apart and then releasing the tube attachment clamp 44, which may feature a quick lock and release fastener. Thereafter a new pleated tube cartridge can be quickly and easily slid on the main body 20 of the nozzle 10 with the open or proximal end 52 then secured by the tube attachment clamp 44, the first and second handles 32, 34 pivoted together to join the first and second collar segments 26, 28 and then clamped together using the retention collar clamps 30.

The first and second handles 32, 34 must be sufficiently rigid to allow for dependable user manipulation and have sufficient tensile strength to adequately retain the tube 50 as it is being loaded, and be able to withstand strain from carrying and controlling the nozzle 10. One inch steel rods which extend about 7 inches off the body and have a length of about 84 inches are believed to be suitable. The retention collar 22, when assembled, preferably has about a 1 inch clearance with the main body 20 of the nozzle 10 with this clearance being taken up by the elastomeric gaskets 24 so that the elastomeric gaskets 24 contact the outer diameter of the nozzle body. Representative dimensions of the embodiments of the nozzle 10 are not intended as any limitation on the scope of the claimed subject matter.

Figure 8:
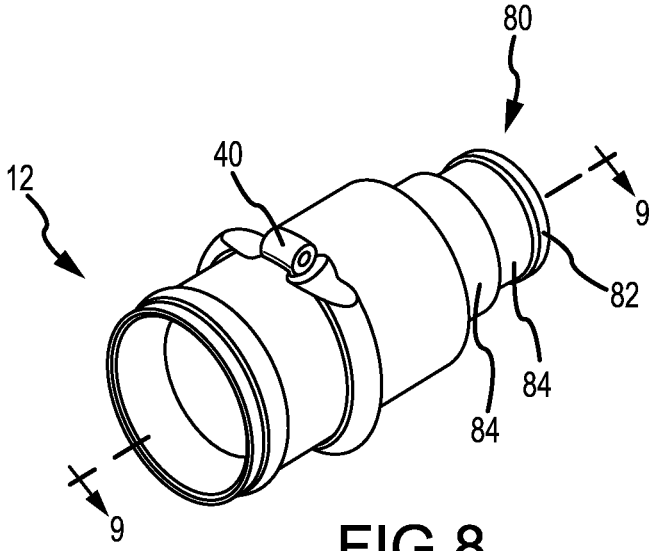
FIG. 8 is a perspective view of an alternative embodiment of a nozzle inlet.
Figure 9:
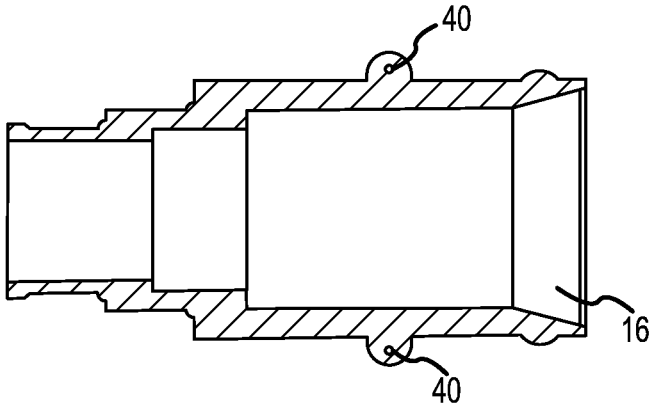
FIG. 9 is a cross-sectional view of the nozzle inlet 12 taken along line 9-9 of FIG. 8.
Figure 10:
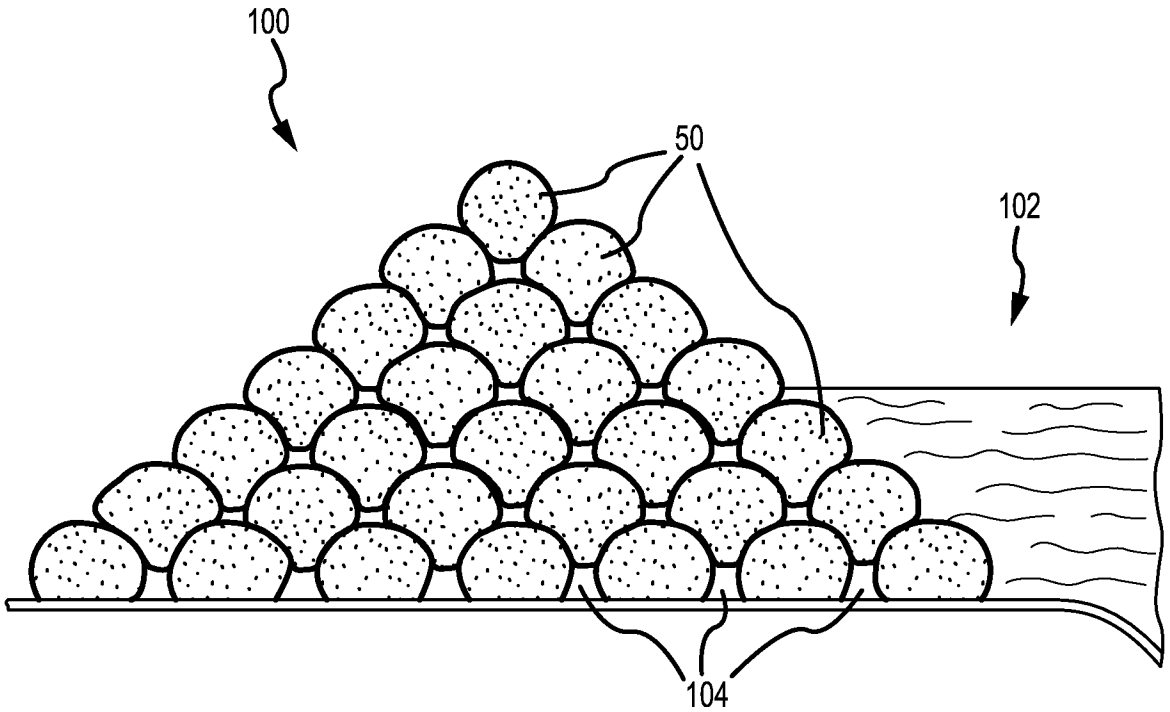
FIG. 10 is a schematic cross-sectional view of an embankment that is constructed using the embankment system disclosed herein.

FIG. 8 is a perspective view of an alternate embodiment of a nozzle inlet 12 comprising a nozzle coupling head 80 configured to attach to the delivery conduit 46 or the hose of any standard concrete boom pump system 60. The illustrated nozzle coupling head 80 may be of different configurations as necessary or desirable for attachment to particular concrete boom pump systems. The nozzle coupling head 80 may be defined by a rim 82 for securing the hose, and a plurality of inlet tunnels 84 of increasing diameter that are welded to the main body of the nozzle inlet 12. Merely by example, the rim 82 may be 0.6 inches lengthwise, and the inlet tunnels 84 may span a total of 10 inches in length. Two opposing hinges 40 (second hinge is hidden from view) on the nozzle inlet 12 are configured to pivotably attach the proximal ends 36 of the first and second handles 32, 34 to the nozzle inlet 12. The hinges 40 may be located upstream or downstream of the flare 16 shown in FIG. 1 or the inlet tunnels 84 of FIG. 8. FIG. 9 is a cross-sectional view of the nozzle inlet 12 taken along line 9-9 of FIG. 8. The two opposing hinges 40 are located upstream of the flare 16 in the particular embodiment of FIG. 9. The material used for the nozzle inlet 12 of FIG. 8 may be a durable milled metal to withstand friction and wear on the nozzle 10. FIG. 10 shows a schematic cross-sectional view of an embankment 100 that is constructed using the embankment system disclosed herein. In operating the embankment system, the tubular bags 50 as they are filled with the sand/concrete slurry are laid in parallel with adjacent tubes 50 with contiguous ends that are staggered to minimize leakage. The embankment 100 is constructed by stacking the tubes 50 in a pyramid-type structure with each consecutive course of tubing nested in a groove of adjacent tubes below, thus forming a seal in the groove depression. The bedding course may be laid with gaps 104 between the parallel tubes 50 to provide for the nesting configuration of the upper courses, whereby the gap 104 size may be based at least in part on maximizing the surface contact of tubes 50 laid in the upper courses. The increased surface contact between tubes 50 provides minimized seepage, for instance by creating a labyrinth seal that limits water seepage from liquid 102 through the wall. Increased surface contact also increases stability of the embankment 100 thereby mitigating risk of collapse.

When the nesting configuration is completed at a desired wall height or a pyramid top is achieved, the embankment 100 will have a pyramid-type cross-section with the base having a width greater than the height of the embankment to provide adequate stability. Merely by example, the height of the embankment 100 may be 6 ft. Because of the modular nature of the system, and because of the particular advantage provided when used with a high-pressure articulating boom pump 60, users will have great flexibility in configuring and placement of the embankments 100 to maximize the utility of the embankment 100. The embankment 100 can have the use of any current embankments, including for retaining or diverting liquids 102 (e.g. water) or mud. Furthermore, the tubes 50 may be manufactured from water-proof sheet material, particularly for tubes 50 that are deployed in liquids 102 to prevent the wash out of slurry and allow the slurry to cure into a solid mass. For example, when the tubes are employed along a flooding streambed. The solid cured slurry may provide an impact resistant structure. Merely by example, as the height of the embankment 100 exceeds the water level 102 the tubing materials may be switched from water-proof to standard bagging materials.

Figure 11:
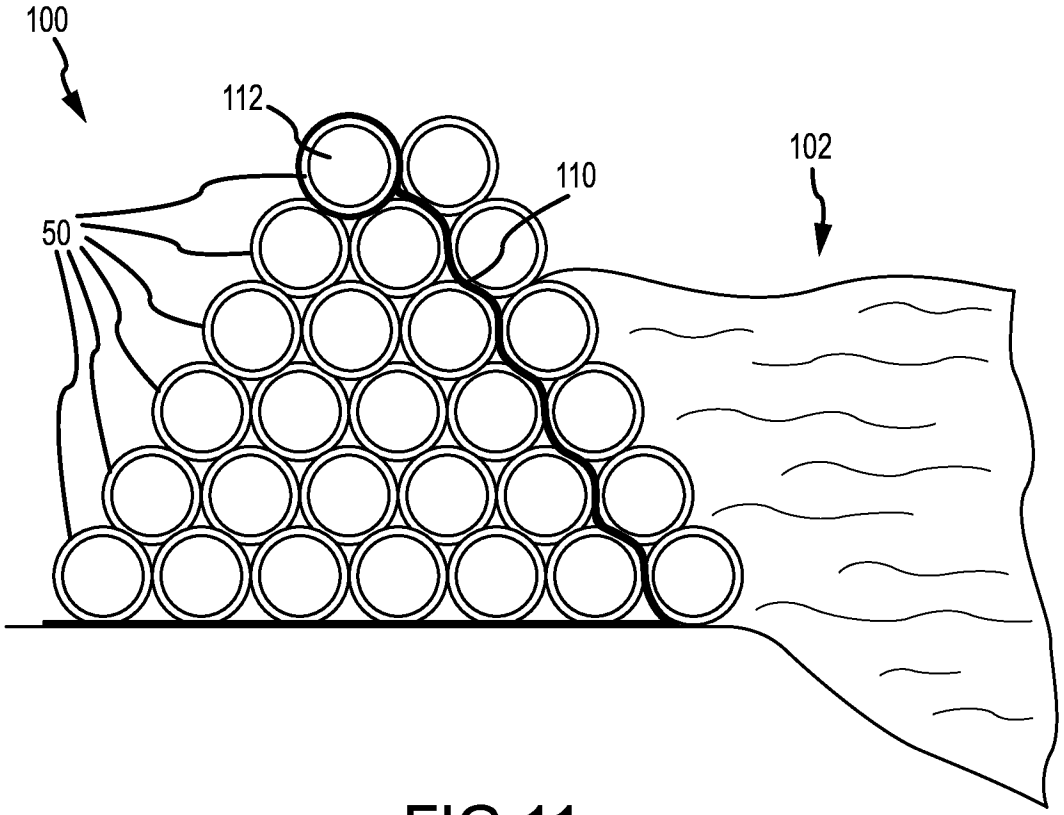
FIG. 11 is a schematic cross-sectional view of an embankment with an inter-woven water-proof membrane.

FIG. 11 shows a schematic cross-sectional view of the embankment 100 with an inter-woven water-proof membrane 110 laid along the surface upon which the embankment 100 is built and woven within the structure of the embankment 100. A layer of slurry filled tubes 50 may cover the membrane 100 to provide protection from weather and impacts that may tear or puncture the membrane 100. The membrane 100 may further be wrapped and secured around a tube 50, such as the particular slurry filled tube 112. The water-proof membrane 100 may be a 45 millimeter rubber membrane to provide minimal or zero wall seepage of the embankment 100.

Figure 12:
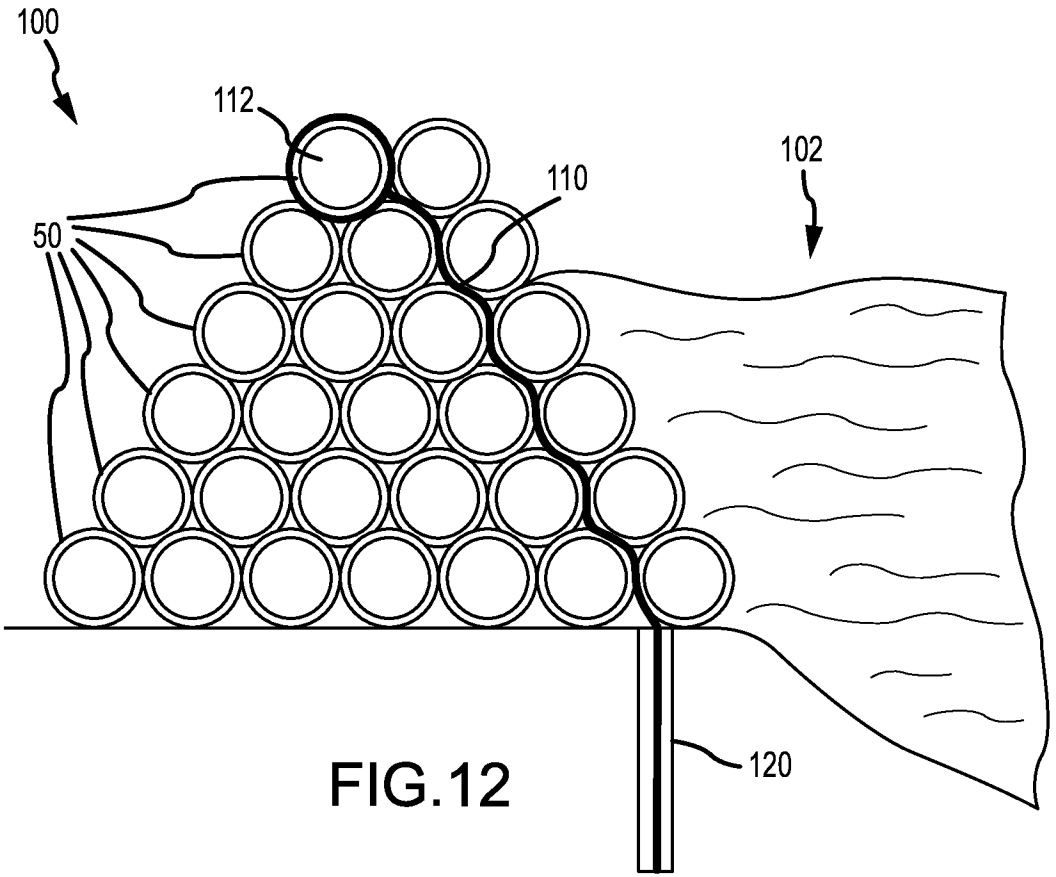
FIG. 12 is a schematic cross-sectional view of an embankment with the inter-woven water-proof membrane extended below ground-level.

FIG. 12 is a schematic cross-sectional view of the embankment 100 with the inter-woven water-proof membrane 110 extending below the embankment 100 into a trench 120. The water-proof membrane 110 is inter-woven in the embankment 100 and laid into the trench 120 that is backfilled with slurry to provide a tight and secure seal below the embankment 100. Trenching requirements will vary from site to site and be determined based on soil and site conditions to properly ensure prevention of below wall seepage. Merely by example, the trench may be 4 ft. deep.

The precise ratio of the sand/concrete slurry can be chosen to provide, for example, sufficient sheer strength to withstand anticipated lateral loads to the embankment (e.g., as a result of the embankment being struck by objects carried by flood waters) or any other requirements of a particular deployment. Use of the sand/concrete slurry provides an embankment that has a much longer serviceable life than sand or water embankment systems. For example, the life may be about 7 years or longer. When used as a long term solution, the dry side of the embankment may be backfilled with soil and seeded with, for example, indigenous grasses to provide a more aesthetically pleasing embankment, than, for example, standard sand bag embankments.

In one embodiment the high pressure articulating boom pump 60 is mounted on a barge or other watercraft to allow access to a shore of a body of water from the body of water. In such an embodiment the supply of sand/concrete slurry may be pumped through a line from shore to the barge. Such embodiment may provide access to an embankment locale that is inaccessible from land, even when using a boom truck.

Various embodiments of the disclosure could also include permutations of the various elements recited in the claims as if each dependent claim was a multiple dependent claim incorporating the limitations of each of the preceding dependent claims as well as the independent claims. Such permutations are expressly within the scope of this disclosure.

While the invention has been particularly shown and described with reference to a number of embodiments, it would be understood by those skilled in the art that changes in the form and details may be made to the various embodiments disclosed herein without departing from the spirit and scope of the invention and that the various embodiments disclosed herein are not intended to act as limitations on the scope of the claims. All references cited herein are incorporated in their entirety by reference.

What is claimed is:

1. A nozzle for use with a source of a high pressure sand/concrete slurry mix, the nozzle comprising an inlet attachable in fluid communication with the source and an outlet spaced lengthwise from the inlet, the nozzle further comprising a collar, the collar being configured to nest the nozzle near the outlet, the collar further comprising first and second collar segments releasably joined by one or more releasable clamps to form the collar, the nozzle further comprising first and second handles each having a proximal and a distal end, each handle being pivotally attached at the proximal end to the nozzle a distance lengthwise of the nozzle outlet and attached at the distal end to a respective first and second collar segment, whereby with the releasable clamps disengaged the first and second collar segments can be pivoted apart by the handles.

2. The nozzle of claim 1 further comprising an elastomeric gasket on the inside of the collar, the elastomeric gasket contacting the nozzle with the collar clamped on the nozzle.

3. The nozzle of claim 1 wherein the handles are metal bars configured to enable manipulation of the nozzle by one or more users.

4. The nozzle of claim 1 wherein the source of high pressure sand/concrete slurry is a high pressure articulating boom pump.

* * * * *